United States Patent [19]

Jellinek et al.

[11] Patent Number: 4,745,024

[45] Date of Patent: May 17, 1988

[54] NON-WOVEN TEXTILES

[75] Inventors: Karl Jellinek, Iserlohn-Letmathe; Arno Gardziella, Witten-Rüdinghausen; Karl-Heinz Schwieger, Iserlohn; Peter Adolphs, Menden-Halingen; Josef Suren, Wünnenberg Haaren, all of Fed. Rep. of Germany

[73] Assignee: Rutgerswerke Aktiengesellschaft, Fed. Rep. of Germany

[21] Appl. No.: 75,111

[22] Filed: Jul. 20, 1987

[51] Int. Cl.[4] ..... D04H 1/58

[52] U.S. Cl. ..... 428/288; 156/330; 156/331.3; 156/335; 428/283; 428/402; 428/413; 525/481; 525/482; 525/489; 525/495; 525/501

[58] Field of Search ..... 428/288, 283, 402, 413, 428/516; 525/481, 495, 501, 482, 489; 156/330, 331.3, 335

[56] References Cited

U.S. PATENT DOCUMENTS

| | | | |
|---|---|---|---|
| 4,454,298 | 6/1984 | Koyama et al. | 525/495 |
| 4,578,425 | 3/1986 | Santorelli | 525/481 |
| 4,656,085 | 4/1987 | Bechen et al. | 428/413 |

*Primary Examiner*—James J. Bell

*Attorney, Agent, or Firm*—Bierman and Muserlian

[57] ABSTRACT

A non-woven textiles comprising a web of organic fibers bonded together by a binder applied to the fibers as a powdered mixture of a non-heat reactive phenolic resin and at least one thermoreactive condensation resin selected from the group consisting of phenolic resins, epoxy resins and amino resins and then fused and a method of producing said textiles.

14 Claims, No Drawings

NON-WOVEN TEXTILES

STATE OF THE ART

Non-woven, resin-bonded textile materials whose web is made of organic fibers such as wool fibers, cotton fibers, rayon staple fibers, polyester fibers and acrylic fibers are known and the fiber material usually is obtained from textile wastes by a willowing process.

These non-woven textiles have been very satisfactorily used for many years as padding and insulating materials in various areas, and particularly they have found acceptance also in automobile construction. Here it is especially the high absorption of sound that lets them find increasing uses and this is true not only in automobile construction but under the aegis of increasing environmental protection, it applies to many other machine equipments and assemblies.

For the production of the webs, all common production technologies can be employed. Preferably, the aerodynamic web formation method is employed in which pre-opened fiber material is further broken up, seized by an air stream, transported, and continuously deposited on a perforated roll to form the web. The bonding agent is scattered in powder form into the web through rolls, vibratory troughs or similar proportioning means. In a following closed system, intensive and uniform distribution of the binder in the web material is provided for by whirling. Thereafter, the now binder-containing fiber material is collected again under suction on the cross section of the fiber web in a nip formed between suction rolls and again deposited as a web.

The curing of the binder and hence the final solidification of the webs to form the non-woven material can also be effected by various technologies. Preferably, the web is run continuously between two wire mesh belts through a long curing duct in which the curing occurs with hot air of 160° to 220° C. sucked or blown through the web. This method furnishes web or plate type non-woven materials. Another possibility for the consolidation of the webs consists in curing the binders by hot pressing, as used particularly for the production of more strongly consolidated plates and shaped parts. To this end, the web is only predried and precured in the curing duct at much lower temperatures with the material being subsequently shaped accordingly in hot presses.

However, non-woven textiles thus obtained have the unpleasant property that occasionally, especially after being subjected to elevated temperatures of 30° to 60° C. and moisture, they spread an objectionable amine odor which is derived from the hardening agent (hexamethylene tetramine) or respectively from the aminic decomposition products thereof. According to EP-A-76,429, this problem is solved in that, before the heat treatment, a substance eliminating ammonia at elevated temperature, in particular urea, is applied onto the surface of the web. Apart from the additional step of applying the urea, this method is extremely limited in its effect.

OBJECTS OF THE INVENTION

It is an object of the invention to make provide phenolic resin-bonded non-woven material in which high-grade products result which do not have an amine odor originating from the binder or other objectionable odor characteristics.

It is another object of the invention to provide a simple process for producing the novel non-woven materials.

These and other objects and advantages of the invention will become obvious from the detailed description.

THE INVENTION

The non-woven textiles of the invention are comprised of a web of organic fibers bonded together by a binder applied to the fibers as a powdered mixture of a non-heat reactive phenolic resin and at least one thermoreactive condensation resin selected from the group consisting of phenolic resins, epoxy resins and amino resins and then fused.

It has been found that even under prolonged moisture action the formation of malodorous amino compounds does not occur in phenolic resin-bonded non-woven textiles of the invention in which textiles are produced with a binder consisting of a powered mixture of a non-thermoreactive phenolic resin, at least one thermoreactive condensation product of the group of the phenolic, amino, or epoxy resins, and possibly an accelerator. Moreover, the non-woven textiles thus produced have a sufficient strength level and a thermal behavior as known and appreciated in the previously known non-woven materials bonded with novolac and hexamethylene tetramine. This is surprising inasmuch as heretofore it was assumed that to obtain a sufficient strength level, relatively large quantities of hexamethylene tetramine were needed as curing agent for novolacs.

Examples of non-thermoreactive resins used in the invention are acid-condensed phenolic resins of the formula

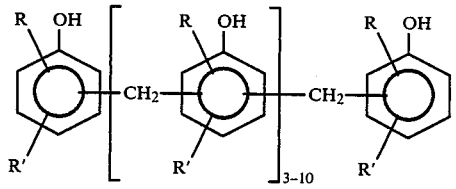

wherein R and R' are individually selected from the group consisting of hydrogen and alkyl of 1 to 9 carbon atoms. The acid condensed phenolic resins are derived from phenol, cresols, xylenols and higher chain alkyl phenols condensed with formaldehyde or compounds yielding formaldehyde under the condensation conditions in a molar ratio of phenol to formaldehyde in the range of 1:0.6 l to 1:0.9.

The thermoreactive resins which may be used individually or as mixtures may be from three different groups, namely phenolic resins, amino resins and epoxy resins. The non-thermoreactive phenolic resin is mixed with one or more of these thermoreactive condensation products in the ratio by weight of from 30:70 to 90:10 and this mixture is used as binder.

Thermoreactive phenolic resins are reaction products from the alkaline condensation of a phenolic component with formaldehyde or a compound eliminating formaldehyde under condensation conditions. Examples of phenolic components that may be used are mono-or poly-nucleic phenols or mixtures of said classes of compounds, namely both mono- and poly-nucleic phenols. Examples of this are phenol itself, as well as alkyl-substituted homologues, thereof such as o-, m- or p-cresol, xylenes or higher alkylated phenols as well a halogensubstituted phenols such as chloro- or bromo-phenol and polyvalent phenols such as resorcinol or pyrocatechin as well as polynucleic phenols such as naphthenes, bisphenol A or bisphenol F. The phenolic components and formaldehyde are preferably used in a molar ratio of 1:1.0 to 1:4.0.

The phenolic resins to be used in the invention namely the thermoreactive as well as the non-thermoreactive ones, must have in total a content of free phenol of less than 1%, and they must be present in powder form.

As thermoreactive amino resins, there may be used both melamine and benzoguanamine or urea-formaldehyde condensation products as well as the co-condensation products thereof. They may be used alone, but preferably in mixture (in any mixture ratio) with the phenol resols as thermoreactive binder component. Examples of epoxy resins are all commercial solid epoxy resins on the basis of bisphenol A and bisphenol F.

All resins used are employed dry and in powder form and the various resin components are mixed with one another as powder. To the binder mixtures thus obtained, particularly those which contain epoxy resins as a thermoreactive component, there may be added 0.1 to 2% by weight of an accelerator such as dicyanodiamide or imidazole derivatives. It is further possible to add to the binders 0.1 to 1% by weight of an odor marking agent. In particular, the commercial long lasting perfume depots guarantee a fragrance of the finished non-woven textile remaining constant for a prolonged time.

The binders of the invention are incorporated into the fiber material by known methods and the ratio of binder to fiber material varies between 10 to 40 and 90 to 60 by weight, depending on the purpose of use. Preferably, the resin content is in the range of 20 to 40% and the resin binding in the web consists essentially in punctiform linkages of the fibers at their crossings. These are obtained by fusion of the resin during manufacture of the non-woven material and to obtain optimum linkage, the individual binder components should melt in the same temperature range. Advantageously, the non-thermoreactive phenolic resin and the thermoreactive condensation product should melt in the temperature range of from 60 to 100° C.

In the following examples there are described several preferred embodiments to illustrate the invention. However, it should be understood that the invention is not intended to be limited to the specific embodiments.

Explanations regarding the table:

As phenolic novolac, there was used a phenol-formaldehyde condensation product with a phenol:formaldehyde molar ratio of 1:0.77, which was produced under the usual technical conditions and had a melting point per DIN 53181 (capillary method) of 90° to 95° C. as well as a content of free phenol per DIN 16916-02-L2 of about 0.3%.

As phenolic resol, there was used an anhydrous alkali-condensed phenol-formaldehyde condensation product with a phenol: formaldehyde ratio of 1:2.0 and a melting point of about 98° C. (sinter point) as well as a content of free phenol of about 1.5%.

The melamine resin used was a melamine-formaldehyde condensation product with a melamine:formaldehyde ratio of 1:2.5 and a melting point of 69° to 72° C.

The epoxy resins used were commercial products (e.g. Rutapox 0194 or Epikote 1004) on a basis of bisphenol A with an epoxy equivalent of 900 to 1000 g/equivalent.

2-phenylimidazole was used as accelerator.

The odor marking agent was a polymer powder (polypropylene) equipped with a flower oil (60%).

The bending strength was measured, for reasons of better reproducibility, on sand shapes (140×20×15 mm) which had been produced by hot pressing (2 min. at 170° C.) of a mixture of 90 parts by weight of quartz sand and 10 parts by weight of resin powder (weighed charge per rod: about 75 g).

The odor score (1=no odor; 2=not objectable; 3=objectionable; 4=extremely objectionable) was established as a relative evaluation and was determined by the following method.

A non-woven material on a basis of a textile fiber mixture produced with 30% by weight of resin powder was pressed at 180° C. to square plates about 10 mm thick (size 250×250 mm). From each of the plates, 3 test pieces (90×200 mm) were punched out and stored in each instance jointly in closed 3-liter glass vessels containing 30 ml of water for 16 hours at 40° C., and then the vessels were opened and judged by a scent team. Separate from the grading as to odor, the presence or absence or amine odor (fish-like) was determined. The results are reported in the following Table.

| Examples: | 1 | 2 | 3 | 4* | 5 | 6 | 7 | Comparison 1 | Comp. 2 |
|---|---|---|---|---|---|---|---|---|---|
| Phenol Novolac % | 60 | 55 | 55 | 55 | 59 | 54 | 36 | 93 | 96 |
| Phenol resol % | 40 | 36 | 35.7 | 36 | — | — | — | — | — |
| Melamine resin % | — | 9 | 9 | 9 | — | 9 | 9 | — | — |
| Epoxy resin % | — | — | — | — | 40 | 36 | 54 | — | — |
| Accelerator % | — | — | — | — | 1 | 1 | 1 | — | — |
| Odor masking agent % | — | — | 0.3 | — | — | — | — | — | — |
| Hexamethylene tetramine % | — | — | — | — | — | — | — | 7 | 4 |
| B time at 150° C.: per DIN 16916-02-C2 sec. | 95 | 85 | 85 | 65 | 100 | 100 | 55 | 100 | 120 |
| Flow length at 125° C. per DIN 16916-02-A mm | 12 | 12 | 12 | 12 | 45 | 30 | 17 | 60 | 40 |
| Bending strength: $N/mm^2$ | 18 | 22 | 22 | 30 | 18 | 21 | 25 | 30 | 18 |
| Odor score: | 2.0 | 2.0 | 1.8 | 2.0 | 2.3 | 2.2 | 2.0 | 4.0 | 3.0 |
| Amine odor: | no | no | no | no | no | no | no | yes | yes |

Note: Homogeneization of the resin powders occurs by premixing, grinding, remixing.

*Components in Example 4 were homogenized before grinding in a two-screw extruder at about 100° C.

Extruder with partial premelting.

Various modifications of the textiles and process of the invention may be made without departing from the spirit or scope thereof and it should be understood that the invention is intended to be limited only as defined in the appended claims.

What we claim is:

1. A non-woven textile comprising a web of organic fibers bonded together by a binder applied to the fibers as a powdered mixture of a non-heat reactive phenolic resin and at least one thermoreactive condensation resin selected from the group consisting of phenolic resins, epoxy resins and amino resins and then fused.

2. A textile of claim 1 wherein the weight ratio of non-thermoreactive phenolic resin to thermoreactive condensation resin is 30:70 to 90:10.

3. A textile of claim 1 wherein the non-thermoreactive phenolic resin is a phenolic resin condensed in an acid medium of the formula

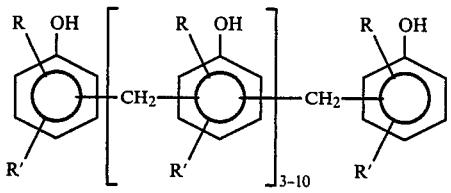

wherein R and R′ are individually selected from the group consisting of hydrogen and alkyl of 1 to 9 carbon atoms.

4. The textile of claim 1 wherein the thermoreactive condensation resin comprises a phenol and formaldehyde condensed in the presence of alkali in a molar ratio of 1:1.0 to 1:4.0.

5. The textile of claim 4 wherein the thermoreactive condensation resin also contains a powdered thermoreactive amino resin.

6. The textile of claim 1 wherein the powdered mixture contain 0.1 to 1% by weight of an accelerator.

7. The textile of claim 1 wherein the powdered mixture contains 0.1 to 1.0% by weight of an odor marking agent.

8. In a method of forming a non-woven textile comprising a web of organic fibers bonded together by a binder wherein the organic fibers are formed into a web, the powdered binder is uniformly distributed into the web and the binder is cured, the improvement comprising using as the binder a powdered mixture of a non-heat reactive phenolic resin and at least one thermoreactive condensation resin selected from the group consisting of phenolic resins, epoxy resins and amino resins.

9. A method of claim 8 wherein the weight ratio of non-thermoreactive phenolic resin to thermoreactive condensation resin is 30:70 to 90:10.

10. A method of claim 8 wherein the non-thermoreactive phenolic resin is a phenolic resin condensed in an acid medium of the formula

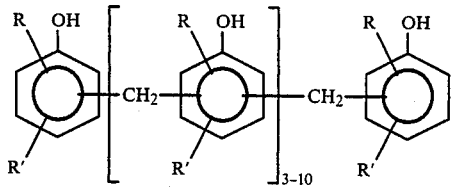

wherein R and R′ are individually selected from the group consisting of hydrogen and alkyl of 1 to 9 carbon atoms.

11. The method of claim 8 wherein the thermoreactive condensation resin comprises a phenol and formaldehyde condensed in the presence of alkali in a molar ratio of 1:1.0 to 1:4.0.

12. The method of claim 8 wherein the thermoreactive condensation resin also contains a powdered thermoreactive amino resin.

13. The method of claim 8 wherein the powdered mixture contain 0.1 to 1% by weight of an accelerator.

14. The method of claim 8 wherein the powdered mixture contains 0.1 to 1.0% by weight of an odor marking agent.

* * * * *

UNITED STATES PATENT AND TRADEMARK OFFICE

CERTIFICATE OF CORRECTION

PATENT NO. : 4,745,024

DATED : May 17, 1988

INVENTOR(S) : Karl Jellinek et al.

It is certified that error appears in the above-identified patent and that said Letters Patent is hereby corrected as shown below:

ON THE TITLE PAGE INSERT:

-- [30] Foreign Priority Data

Germany July 28, 1986 3625443 --.

Signed and Sealed this

Eighth Day of November, 1988

*Attest:*

DONALD J. QUIGG

*Attesting Officer*

*Commissioner of Patents and Trademarks*